US010099502B2

(12) United States Patent
Peleman

(10) Patent No.: US 10,099,502 B2
(45) Date of Patent: Oct. 16, 2018

(54) METHOD FOR BINDING A BUNDLE OF SHEETS OF PAPER, BOOK OR FOLDER THEREBY OBTAINED, BUNDLE OF SHEETS

(71) Applicant: UNIBIND LIMITED, Nicosia (CY)

(72) Inventor: Guido Peleman, Antwerp (BE)

(73) Assignee: UNIBIND LIMITED, Nicosia (CY)

( * ) Notice: Subject to any disclaimer, the term of this patent is extended or adjusted under 35 U.S.C. 154(b) by 0 days.

(21) Appl. No.: 15/502,868

(22) PCT Filed: Jul. 13, 2015

(86) PCT No.: PCT/IB2015/001167
§ 371 (c)(1),
(2) Date: Feb. 9, 2017

(87) PCT Pub. No.: WO2016/024151
PCT Pub. Date: Feb. 18, 2016

(65) Prior Publication Data

US 2017/0232777 A1 Aug. 17, 2017

(30) Foreign Application Priority Data

Aug. 11, 2014 (BE) ..... 2014/0610

(51) Int. Cl.
*B42C 11/04* (2006.01)
*B42C 9/00* (2006.01)
(Continued)

(52) U.S. Cl.
CPC ..... *B42C 11/04* (2013.01); *B42C 5/00* (2013.01); *B42C 9/0006* (2013.01); *B42C 11/02* (2013.01)

(58) Field of Classification Search
CPC ..... B42C 19/02; B42C 7/006; B42C 5/02; B42C 19/00; B42C 13/00; B42C 5/00; B42D 1/006; B42D 15/008; B42D 1/004; B42D 1/06; B42D 1/08; B42D 1/00; B65H 45/30; B65H 2801/48
(Continued)

(56) References Cited

U.S. PATENT DOCUMENTS 379,334 A * 3/1888 Ryan ..... B42C 5/00 281/40
696,281 A * 3/1902 Toole ..... B42C 5/00 281/40
(Continued)

FOREIGN PATENT DOCUMENTS

WO 2014/072778 A1 5/2014

OTHER PUBLICATIONS

International Search Report, dated Oct. 12, 2015, from corresponding PCT application.

*Primary Examiner* — Shin H Kim
(74) *Attorney, Agent, or Firm* — Young & Thompson

(57) ABSTRACT

Method for binding a bundle (5) of sheets (1), whereby an edge (2) of the bundle (5) of sheets (1) is bound, whereby use is made of sheets (1) in which a strip (4) of each of the sheets (1) is double folded separately beforehand along the same line to form a fold line (3) parallel to and at a distance (A) from the aforementioned edge (2). If paper with a density of less than 120 grams per square meter is used for the sheet (1), after having been double folded the strip (4) is folded at least once more along the aforementioned fold line (3).

21 Claims, 5 Drawing Sheets

(51) Int. Cl.
*B42C 5/00* (2006.01)
*B42C 11/02* (2006.01)

(58) Field of Classification Search
USPC ..... 412/4–8; 281/21.1, 40, 41, 42
See application file for complete search history.

(56) References Cited

U.S. PATENT DOCUMENTS 1,897,839 A * 2/1933 Gale ..... B42C 5/00 281/40
1,913,320 A * 6/1933 Woodward ..... B42D 5/021 281/21.1
4,289,330 A * 9/1981 Wiermanski ..... B42C 9/0006 281/21.1
4,525,116 A * 6/1985 Holmberg ..... B42D 15/008 281/29
5,066,182 A * 11/1991 Stonebraker ..... B42B 5/00 281/21.1
5,156,510 A * 10/1992 Uehara ..... B42D 3/002 156/325
5,207,456 A * 5/1993 Danhoff ..... B42D 1/004 281/29
5,340,155 A * 8/1994 Podosek ..... B42D 1/02 281/21.1
5,524,998 A * 6/1996 Schwartz ..... B42D 13/00 281/21.1
6,095,565 A * 8/2000 Kramer ..... B42D 9/00 116/235
6,250,867 B1 * 6/2001 Gwyn ..... B42D 3/002 281/15.1
6,364,590 B1 * 4/2002 Gayoso ..... B42C 7/005 270/52.08
6,402,450 B1 * 6/2002 Kritzinger ..... B42C 19/02 270/4
6,709,374 B2 * 3/2004 Neubauer ..... B65H 37/04 493/405
7,211,311 B2 * 5/2007 McDonald ..... B42D 15/008 428/121
7,246,981 B2 * 7/2007 Parker ..... B42C 9/0006 281/21.1
7,316,517 B2 * 1/2008 Russo ..... B42D 15/008 281/29
7,571,935 B2 * 8/2009 Thompson ..... B42C 1/00 281/38
8,708,372 B2 * 4/2014 Buttner ..... B42F 11/02 281/21.1
8,925,968 B2 * 1/2015 Sada ..... B42D 1/004 281/9
9,630,441 B1 * 4/2017 King ..... B42D 1/08
9,738,103 B2 * 8/2017 Kato ..... B42C 11/04
9,751,354 B2 * 9/2017 Coombe ..... B42B 2/00
2005/0079968 A1 * 4/2005 Trovinger ..... B42C 19/02 493/356
2010/0158639 A1 * 6/2010 Manico ..... B42D 1/002 412/37
2010/0177119 A1 * 7/2010 Farrell et al. ..... B42D 3/002 281/15.1
2011/0299869 A1 * 12/2011 Tai et al. ..... B42C 7/005 270/52.08
2014/0112736 A1 * 4/2014 Peleman ..... B42C 19/02 270/4
2014/0178153 A1 * 6/2014 Hocking ..... B65H 37/04 493/405
2017/0232777 A1 * 8/2017 Peleman ..... B42D 15/008 428/121

* cited by examiner

METHOD FOR BINDING A BUNDLE OF SHEETS OF PAPER, BOOK OR FOLDER THEREBY OBTAINED, BUNDLE OF SHEETS

BACKGROUND OF THE INVENTION

Field of the Invention

The present invention relates to a method for binding a bundle of sheets of paper, for example to form a book or similar, in particular to obtain a book or folder whose sheets can be opened flat and the printing runs seamlessly across the two open sheets. This last-mentioned is particularly desired for composing books of photographs, magazines and similar with photographs and illustrations that run across the entire width of the open book.

Description of the Related Art

A method as described in BE 2012/0759 and BE 20113/0014 is already known, whereby an edge of the bundle of sheets of paper is introduced into the binding spine and fastened therein, whereby for the binding use is made of a bundle of sheets where a strip of each sheet is double folded separately along the same line to form a fold line that extends parallel to and at a distance from the aforementioned edge.

Double folded here means that the strip is first folded in the one direction and then folded in the other direction.

An advantage of such a method is that the fold line enables the sheets to be folded along this fold line when the book is opened and that when the bundle of sheets is bound in the spine with their sharp fold lines against one another, the sheets can be opened flat and the printing can continue across two adjacent fold lines as good as seamlessly across opened sheets.

Another advantage is that when the bundle is opened there is no gap between the opened sheets, so that the adhesive or stitching or staples that are used to bind the bundle in the spine are not visible and thus do not interfere with the printing that continues from the one sheet to the other sheet.

However, practice has shown that although such a method works well and can bring about the desired advantages for paper with a weight of 120 grams or 140 grams per square meter, the results for paper with a weight of less than 120 grams per square meter are not so good.

This means that the method will yield very good results for thicker sheets, but the results are not so good for thinner sheets. More specifically the opening of such sheets along the fold line in a bundle will proceed less smoothly. As a result it will often be possible that the pages do not lie perfectly flat.

BRIEF SUMMARY OF THE INVENTION

The purpose of the present invention is to provide a solution to this.

To this end the invention concerns a method for binding a bundle of sheets of paper, whereby an edge of the bundle of sheets is bound, whereby for binding use is made of a bundle of sheets in which a strip of each of the sheets is double folded separately beforehand along the same line to form a fold line that extends parallel to and at a distance from the aforementioned edge, whereby according to the invention, for a sheet of paper with a density of less than 120 grams per square meter, after having been double folded the strip is folded at least once more along the aforementioned fold line.

The advantage of such a method is that by additionally folding the sheet, the results are better and comparable to a thicker sheet with a weight of 120 grams or 140 grams per square meter.

Note that the problem and the solution to it is not obvious to a person skilled in the art and in principle even goes against intuition.

Indeed, as practice has shown that the known method gives the desired result for thicker sheets, a person skilled in the art would be least of all inclined to fold a thinner sheet once again.

Nevertheless such a method according to the invention ensures that the desired result is achieved for sheets with a weight of less than 120 grams per square meter.

The invention also concerns a bundle of sheets of paper, whereby a strip of each of the sheets is double folded separately along the same line to form a fold line that extends parallel to and at a distance from an edge, whereby for a sheet of paper with a weight of less than 120 grams per square meter, after having been double folded the strip is folded at least once again along the aforementioned fold line.

Furthermore the invention also concerns a book or folder with a binding spine and a bundle of sheets bound therein, whereby the bound bundle is a bundle according to the invention.

BRIEF DESCRIPTION OF THE DRAWINGS

With the intention of better showing the characteristics of the invention, a preferred method for binding a bundle of sheets according to the invention is described hereinafter by way of an example, without any limiting nature, with reference to the accompanying drawings, wherein.

DETAILED DESCRIPTION OF THE PREFERRED EMBODIMENTS

FIGS. 1 to 4 schematically show a method for producing a double-folded sheet of paper 1.

Figure 1:
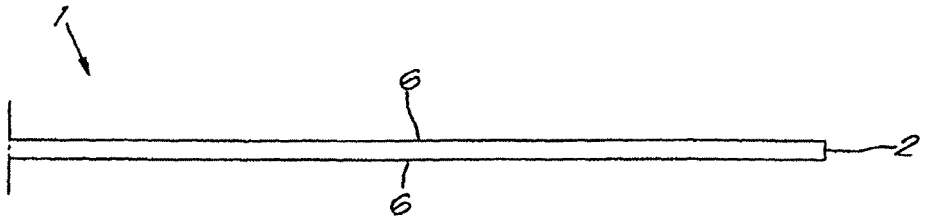
FIGS. 1 to 7 schematically show successive steps of a method according to the invention.
Figure 2:
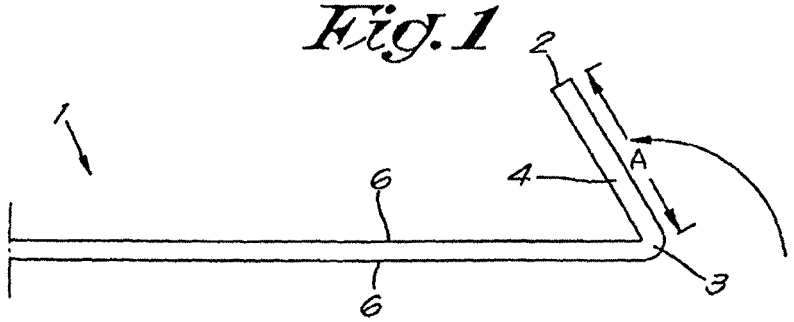

To this end an edge 2 of a sheet 1 is folded in one direction along a fold line 3 that is parallel to the edge 2 and at a distance A therefrom, as can be seen in FIG. 2. In this way a strip 4 is formed that is demarcated by a fold line 3.

Figure 3:
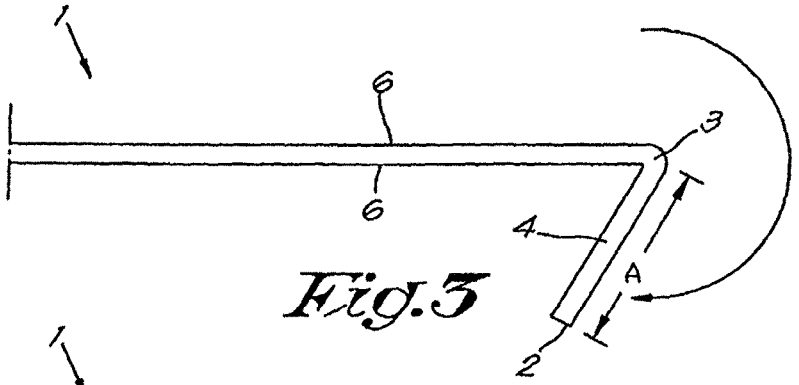

Then the strip 4 is folded in the other direction along the sharp fold line 3 as can be seen in FIG. 3.

In this way a double-folded sheet 1 is made.

Preferably the strip 4 for forming a sharp fold line 3 is completely folded back twice. In this way the fold line 3 forms a flexible hinge as it were, along which the sheet 1 can be flexibly turned back and forth with respect to the strip 4.

The distance A between the edge 2 and the fold line 3 is equal to the width of the strip 4. The distance A is preferably between 10 and 24 millimeters.

According to the invention, when the sheet has a weight of less than 120 grams per square meter, the strip 4 is folded again as shown in FIG. 2.

Additionally, but not necessarily, the strip 4 can be folded again in the other direction, as shown in FIG. 3.

In this way the strip 4 is double folded twice.

Figure 4:
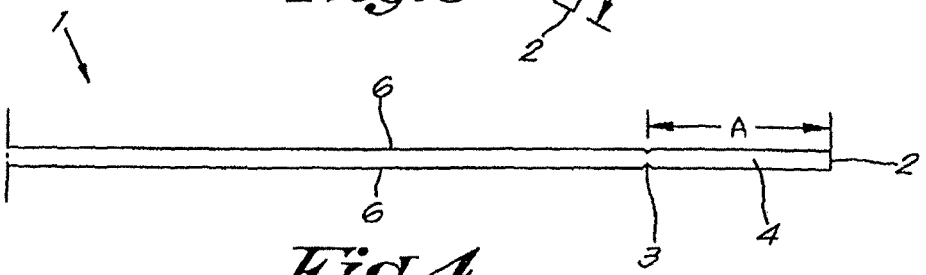

Finally, as shown in FIG. 4, the strip 4 is folded back to be in line with the sheet 1.

However, it is not excluded that the strip 4 is folded again a number of times. Indeed, depending on the type of paper and the weight of the paper the strip 4 is folded back as many times until the desired result is obtained, this means until the sheet 1 can be easily and readily folded at the location of the fold line 3.

Figure 5:
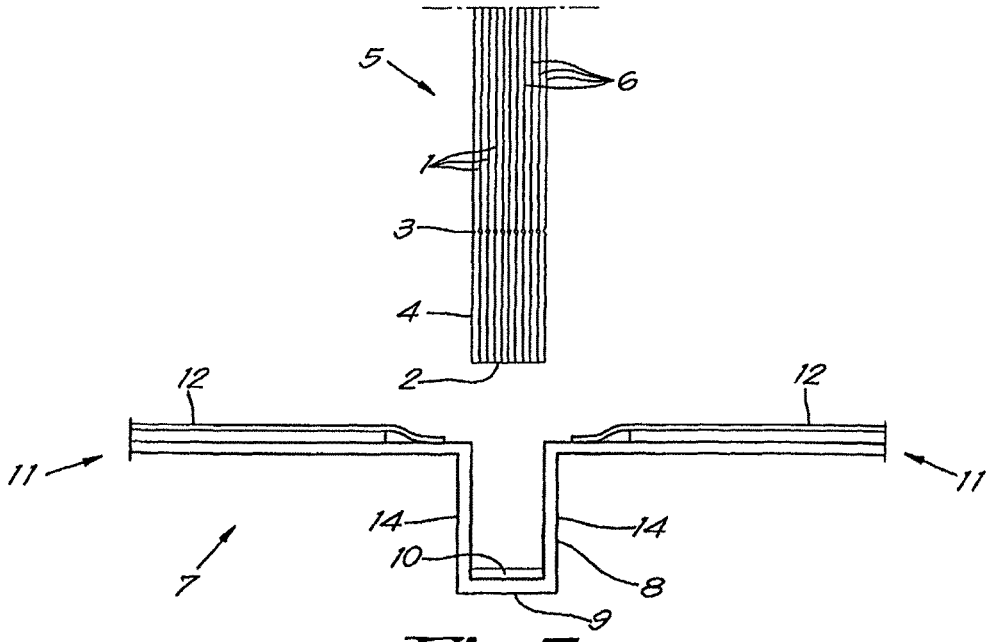
Figure 6:
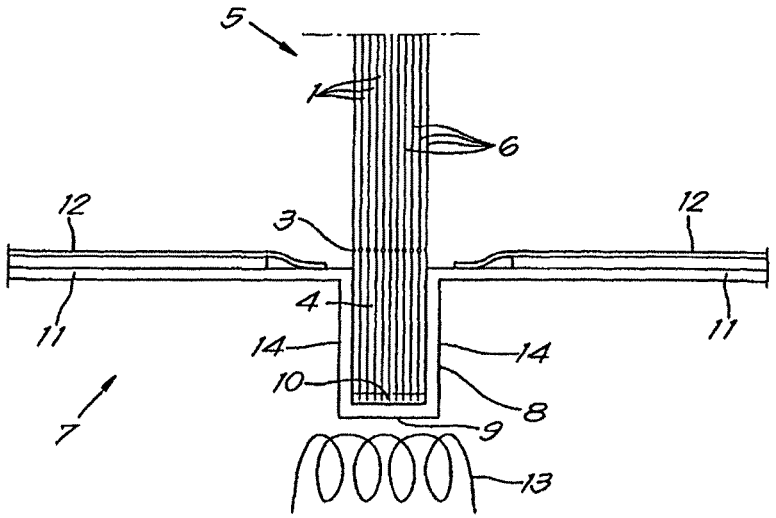
Figure 7:
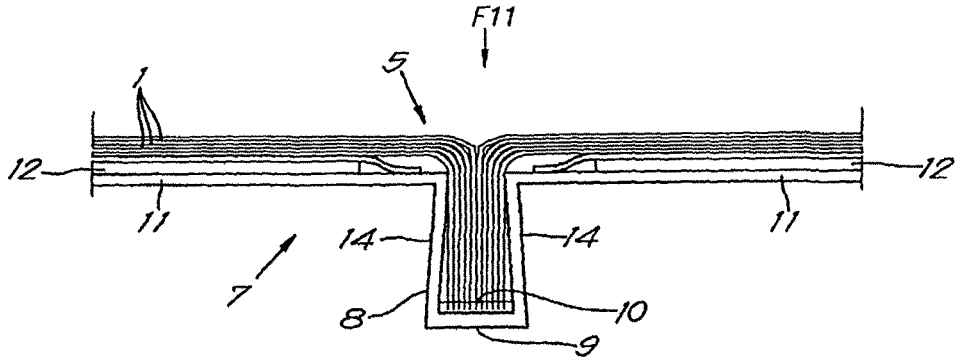

FIGS. 5 to 7 schematically show a method for binding a bundle 5 of double-folded sheets 1.

In the following double-folded sheets 1 also means sheets 1 that, after having been double folded, are folded again at least once as described above.

As can be seen in FIG. 5, the bundle 5 consists of a number of double-folded sheets 1 that are placed with their sides against one another, whereby the edges 2 of the sheets 1 to be bound are aligned with respect to one another.

Preferably the bundle 5 comprises at least one sheet 1 with a density of less than 120 grams per square meter.

According to the invention it is not excluded that the sheets 1 have a different density. For example, some of the sheets 1 can have a density of less than 120 grams per square meter and some of the sheets 1 have a density greater than or equal to 120 grams per square meter.

Hereby in the example shown the distance A is the same for all sheets. However, it is also possible for the sheets 1 of the bundle 5 to be double folded at different distances from the edge 2 to be bound, whereby the first sheet is folded at a distance A, the second sheet at a distance A plus approximately the thickness of one sheet 1, the third sheet at a distance A plus approximately twice the thickness of one sheet and so on until the middle of the bundle, after which the distances decrease symmetrically such that the last sheet 1 of the bundle 5 is folded at a distance A from the edge.

In order to bind the bundle 5, in this example use is made of a binding spine 7.

In this case the binding spine 7 consists of a U-shaped part 8, for example of metal with a layer of hot-melt adhesive 10 on the base 9.

In this case, the binding spine 7 is further provided with two endpapers 11 of a book or folder, for example of cardboard that are provided on either side with a covering 12.

It is clear that the binding spine 7 can also take on other forms such as a V-shaped binding spine for example or can only be provided with one endpaper 11.

The bundle 5 is placed in the U-shaped part 8 of the binding spine 7, whereby the edges 2 of the double-folded sheets 1 are placed against the layer of hot-melt adhesive 10, as shown in FIG. 6.

Hereby the fold line 3 of the double-folded sheets 1 is somewhat above the U-shaped part 8. This occurs because the distance A primarily corresponds to the depth of the binding spine 7 or is somewhat greater than the depth of the binding spine 7.

Then the layer of hot-melt adhesive 10 is heated by means of a heat source 13. The hot-melt adhesive 10 will hereby melt and become liquid, such that the double-folded sheets 1 of the bundle 5 can be introduced therein.

After the hot-melt adhesive 10 has solidified, the bundle 5 is attached to the bundle 7 by the hot-melt adhesive 10.

Then, as can be seen in FIG. 7, the arms 14 of the U-shaped part 8 of the binding spine 7 are squeezed together. This will ensure an extra sturdy fixation of the bundle 5 in the binding spine 7 and the close fit of the bundle 5 against the free edges of the arms 14 without a gap being visible between the two.

It is also clear that the squeezing shut of the arms 14 of the U-shaped part 8 of the binding spine 7 can be omitted.

The bound bundle 5 is now finished into a folder with bound sheets 1.

As can be seen in FIG. 7, upon opening the bundle 5 the double-folded sheets 1 will extend in a single plane.

By applying a method according to the invention, not only will the thicker sheets with a weight of 120 or 140 grams per square meter for example, but also thinner sheets with a weight of less than 120 grams per square meter, give the desired result.

In reality the result is better than shown in the drawings, which give a somewhat distorted picture because a certain thickness has been given to the sheets for clarity.

Figure 8:
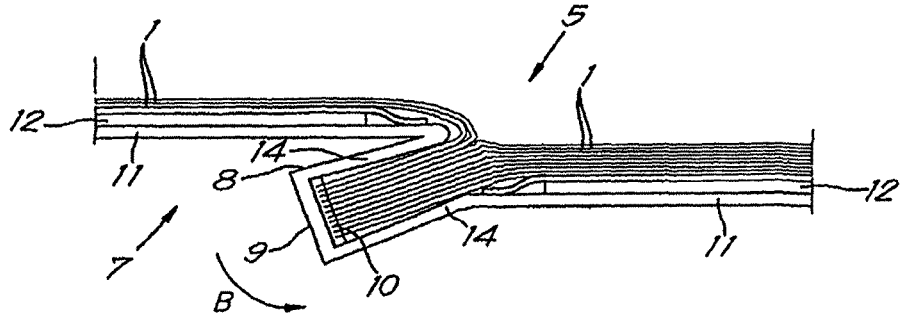
FIGS. 8 to 10 schematically show the bundle of FIG. 7 when leafing through it.
Figure 9:
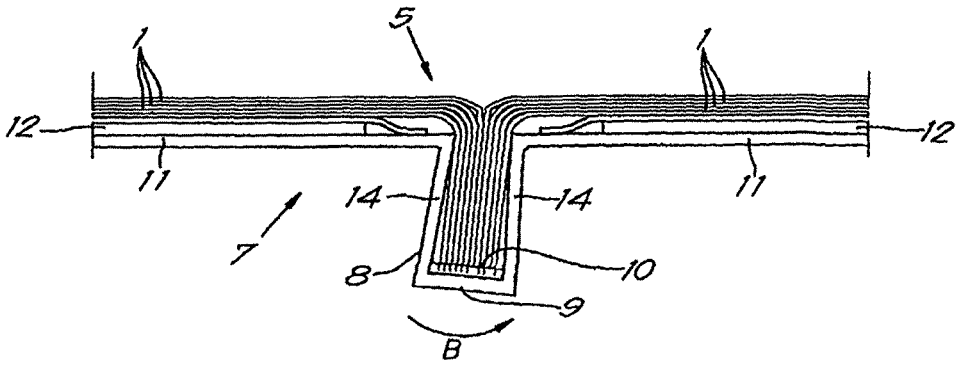
Figure 10:
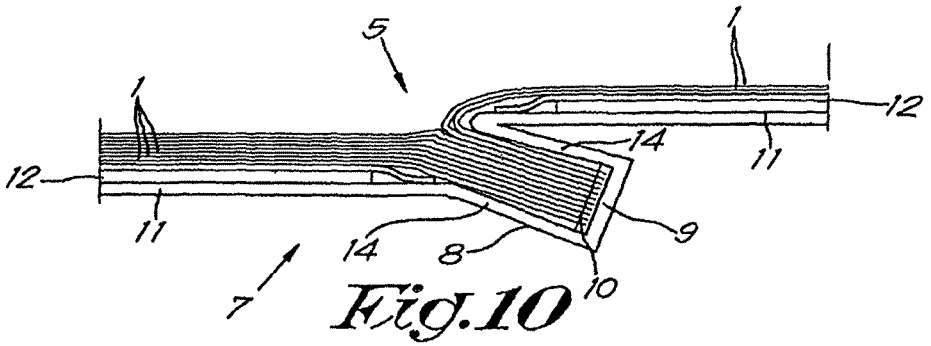

FIGS. 8 to 10 schematically show how the U-shaped part 8 of the binding spine 7 will turn while being leafed through.

When an endpaper 11 is opened, it is will be able to be folded to against the arm 14 of the U-shaped part 8, as can be seen in FIG. 8.

When leafing through further, the arm 14 of the U-shaped part 8 will move away from this endpaper 11 because the U-shaped part 8 will turn according to arrow B towards the other endpaper 11. This is shown in FIG. 9.

When leafing through further, as shown in FIG. 10, the U-shaped part 8 of the binding spine will turn further until the other arm 14 of the binding spine 7 is finally against the other endpaper 11.

This turning of the binding spine 7 will be done automatically as it were while leafing through the bundle 5 and will ensure that the sheets 1 extend flat when the bundle 5 is opened at a certain page.

Figure 11:
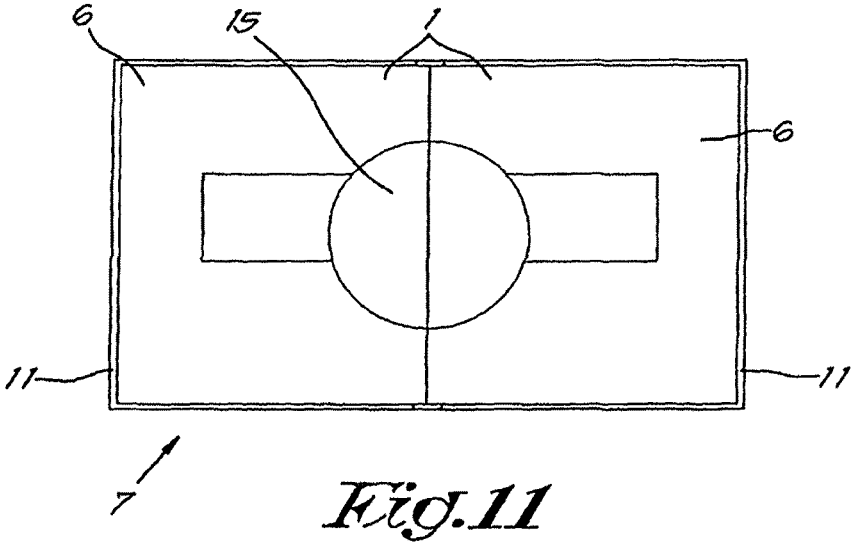
FIG. 11 schematically shows a view according to the arrow F11 in FIG. 7.

As presented in FIG. 11, the sides 6 of the double-folded sheets 1 are printed, for example with a part of an illustration 15 or photograph, whereby the illustration 15 as good as seamlessly runs across from the one double-folded sheet 1 to the other double-folded sheet 1 to thus form one continuous illustration. In this way large photographs can extend over two sheets 1 in a photo album and this without an interfering gap between the two.

Figure 12:
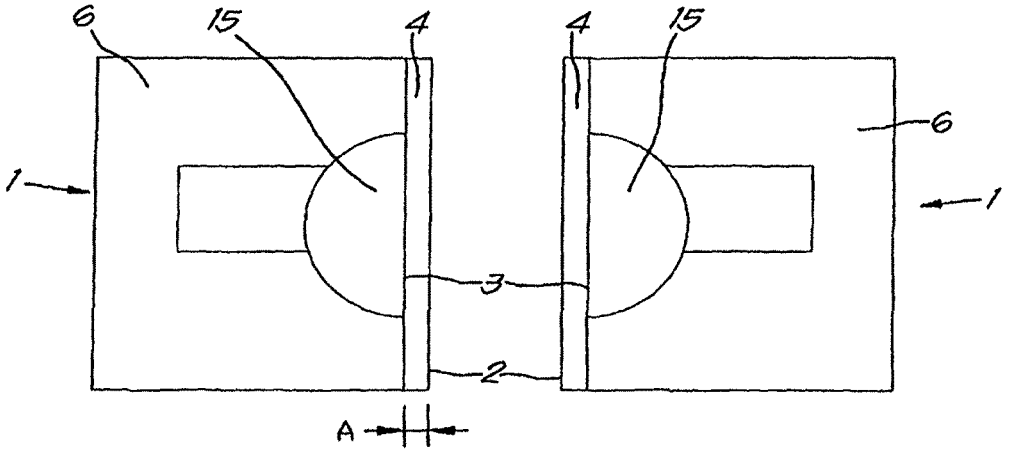
FIG. 12 schematically shows the folded sheets of FIG. 11, but in a separated state.

FIG. 12 shows two printed double-folded sheets, whereby after binding the printing 15 on both sheets 1 together will form a whole.

Hereby the printing 15 is printed up to the fold line 3 whereby the strip 4 remains unprinted.

Figure 13:
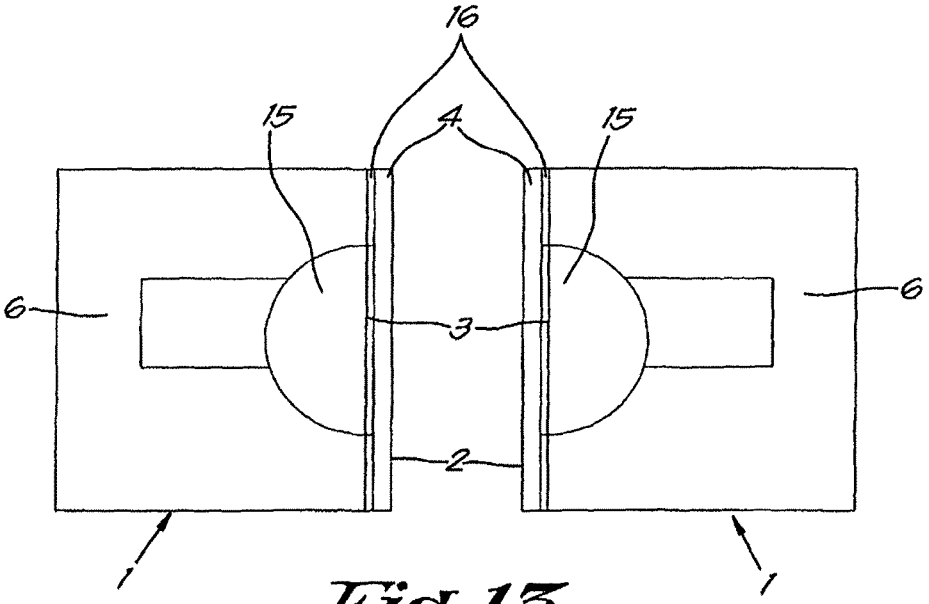
FIG. 13 schematically shows an alternative embodiment of FIG. 12.

FIG. 13 shows a variant of this, whereby a part 16 of the strips 4 are also printed with an overlapping part of the printing 15.

Figure 14:
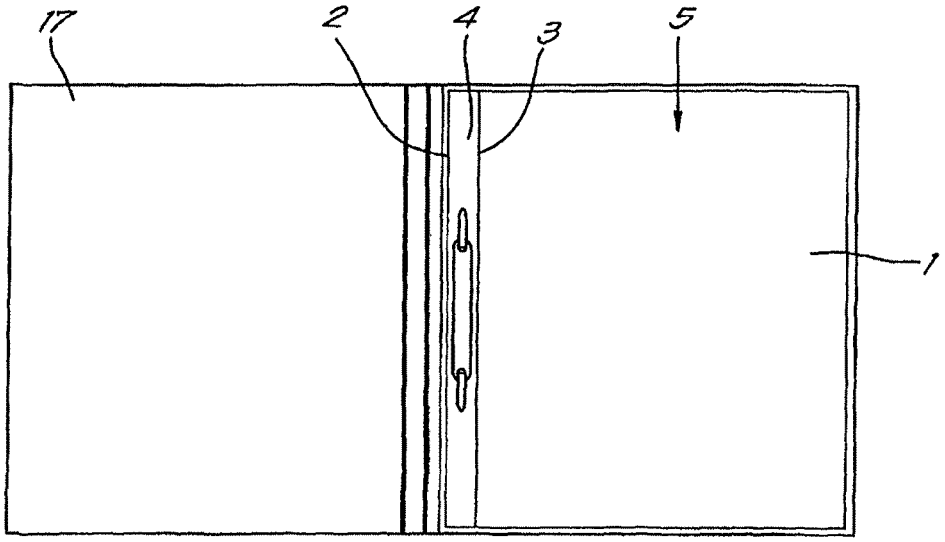
FIG. 14 schematically shows a variant of FIG. 7.

FIG. 14 shows a variant, whereby the bundle 5 is bound by making use of a file folder. Such file folders are produced by Leitz® for example. To this end the sheets 1 are provided with the necessary perforations and the distance A is preferably equal to 20 mm.

It is clear that in the example of FIG. 5 the hot-melt adhesive 10 in the binding spine 7 can be omitted and that the bundle 5 can be stapled before being placed in the binding spine 7.

It is also clear that it is possible that, in order to bind the bundle 5 of sheets 1, the bundle 5 is stapled at a distance from the edge 2 that is smaller than the distance A without making further use of a binding spine 7. It is clear that it is not excluded that for the method according to the invention use is made of a bundle 5 of sheets 1 of a different thickness, whereby for the sheets 1 with a greater thickness the strip 4 is double folded and for the sheets with a smaller thickness the strip 4 is then folded or double folded again.

It is clear that it is not excluded that the method according to the invention is also applied for sheets (1) with a density of 120 grams per square meter or greater.

The present invention is by no means limited to the embodiments described as an example and shown in the drawings, but a method for binding bundles of sheets according to the invention can be realised in different variants without departing from the scope of the invention.

The invention claimed is:

1. A method for binding a bundle of sheets of paper, comprising the steps of:

separately double-folding a strip of each of a plurality of sheets of paper along a same line to form a fold line that extends parallel to and at a distance (A) from an edge of each sheet of paper to obtain folded sheets of paper, wherein at least one of the folded sheets of paper is a sheet of paper with a weight of less than 120 grams per square meter;

after said double-folding step, a further folding step of folding the strip of each of the at least one sheet of paper having a weight of less than 120 grams per square meter, at least once more along the fold line to obtain at least one twice folded sheet of paper so as to have an additional folding as compared to sheets of paper with a weight not less than 120 grams per square meter;

after said further folding step, arranging the folded sheets of paper and the at least one twice folded sheet of paper to obtain the bundle of sheets of paper with the edge defining an edge of the bundle of sheets of paper; and after said arranging step, binding the edge of the bundle of sheets of paper to thereby form a bound bundle of sheets of paper.

2. The method according to claim 1, wherein, in said further folding step, the strip of the at least one sheet of paper with a weight of less than 120 grams per square meter, is folded a second time along the aforementioned fold line so that finally the at least one sheet of paper with a weight of less than 120 grams per square meter has been double folded twice.

3. The method according to claim 1, wherein, after said binding step, the bound bundle of sheets of paper opens with the sheets of paper being in a single plane.

4. The method according to claim 1, wherein, in said double-folding step, all of the sheets of paper are double folded at a same distance (A) from the edge to be bound.

5. The method according to claim 1, wherein the distance (A) between the fold line and the edge of the sheets of paper is chosen such that upon opening of the bound bundle of sheets of paper, the sheets of paper extend flat or practically flat.

6. The method according to claim 1, wherein the distance (A) is between 10 and 24 mm.

7. The method according to claim 1, wherein, said binding step uses a binding spine that is a V-shaped or U-shaped binding spine, and the distance (A) essentially corresponds to a depth of the binding spine.

8. The method according to claim 1, wherein, said binding step uses a binding spine that is a V-shaped or U-shaped binding spine, and the distance (A) is greater than a depth of the binding spine.

9. The method according to claim 7, wherein the binding spine is a metal binding spine that is provided with a hot-melt adhesive which upon binding is made to melt in order to hold the sheets of paper along the edge of the bound bundle of sheets of paper after solidifying.

10. The method according to claim 7, wherein arms of the binding spine are squeezed together after introducing the bound bundle of sheets of paper to clamp the bound bundle of sheets of paper in the binding spine.

11. The method according to claim 1, wherein to bind the bound bundle of sheets of paper, the bound bundle of sheets of paper is stapled at a distance from the edge of the bound bundle of sheets of paper that is less than the distance (A).

12. The method according to claim 1, wherein the sheets of paper are provided with printing that continues up to the fold line.

13. The method according to claim 1, wherein sides of adjacent sheets of paper oriented towards one another are provided with printing beforehand, which runs seamlessly across the fold line of the adjacent sheets of paper from one side to an opposite side to which a part of the printing is applied on the one side up to the fold line of the one sheet of paper concerned and another part of the printing of the opposite side is applied up to the fold line of the adjacent sheet of paper.

14. The method according to claim 13, wherein the printing on the one side and the printing on the opposite side continues over the fold line with an overlapping section.

15. The method according to claim 1, wherein said binding step uses a binding spine, with one or two endpapers of a folder or book affixed to the binding spine.

16. The method according to claim 15, wherein the endpapers can be folded completely outwards with respect to arms of the binding spine up to against or almost against the arms of the binding spine.

17. The method according to claim 1, wherein the bundle of sheets of paper comprises sheets of paper of different weights.

18. A method of preparing a bundle of sheets of paper, comprising at least one sheet of paper having a weight of less than 120 grams per square meter, whereby a strip of each of the sheets of paper is double folded separately along a same line to form a fold line that extends parallel to and at a distance (A) from an edge of each sheet of paper, the strip of the at least one sheet of paper with a weight of less than 120 grams per square meter, after having been double folded the strip is folded at least once more along the fold line so as to have an additional folding as compared to sheets of paper with a weight not less than 120 grams per square meter.

19. The method of preparing the bundle of sheets of paper according to claim 18, wherein the strip of the at least one sheet of paper with a weight of less than 120 grams per square meter is folded a second time along the fold line so that the at least one sheet of paper with a weight of less than 120 grams per square meter is finally double folded twice.

20. The method of preparing the bundle of sheets according to claim 18, wherein the sheets of the bundle are flat because the strip of each of the sheets of paper is folded back into a plane of the sheet of paper and that the distance (A) is between approximately ten and fourteen millimeters.

21. A method of preparing a book or a folder with a binding spine, comprising the step of binding the bundle of sheets of paper prepared according to claim 18 in the binding spine.

* * * * *